United States Patent [19]

Hanson

[11] 4,362,043

[45] Dec. 7, 1982

[54] PIPE UNIONS

[76] Inventor: Thomas A. Hanson, 357-7 Devonshire Ave., Woodstock, Ontario, Canada

[21] Appl. No.: 194,957

[22] Filed: Oct. 8, 1980

Related U.S. Application Data

[63] Continuation-in-part of Ser. No. 614,127, Sep. 17, 1975, abandoned.

[51] Int. Cl.[3] ..... B21K 1/16

[52] U.S. Cl. ..... 72/354; 72/356; 72/370

[58] Field of Search ..... 72/354, 359, 367, 370, 72/356, 377; 285/334.4

[56] References Cited

U.S. PATENT DOCUMENTS

| | | | |
|---|---|---|---|
| 1,151,753 | 8/1915 | Bates | 72/354 |
| 1,338,462 | 4/1920 | Rydbeck | 72/354 |
| 1,354,779 | 10/1920 | Rydbeck | 72/354 |
| 1,817,854 | 8/1931 | Sorensen | 72/370 |
| 2,027,406 | 1/1936 | Spatta | 72/356 |
| 2,646,996 | 7/1953 | Parmesan | 285/334.4 |
| 3,648,509 | 3/1972 | McDowell | 72/367 |
| 3,752,509 | 8/1973 | Stafford | 285/334.4 |
| 4,122,701 | 10/1978 | Lehnhart | 72/354 |

FOREIGN PATENT DOCUMENTS

| | | | |
|---|---|---|---|
| 309762 | 4/1929 | United Kingdom | 72/359 |
| 396159 | 8/1973 | U.S.S.R. | 72/370 |

*Primary Examiner*—Lowell A. Larson

[57] ABSTRACT

According to the present invention, a new cold working metal process is disclosed for the formation of metal pipe union components, which includes blanks for so called gas meter swivels, which are actually pipe unions components with a slight adaptation. Both male and female components are made by the process. The process cold works a metal elongated hollow open ended blank to deform an unsupported circumferential portion of the blank wall into a predetermined shape. The steps of the process comprise supporting portions of the blank wall exterior and interior in a manner to define a shaping section of the predetermined shape in the area of the unsupported wall portion; applying a compressive load on the blank ends of sufficient force to exceed the compressive yield strength of the metal blank thereby deforming the unsupported wall portions to cause the deforming metal to flow into the shaping section to provide the predetermined shape. Pipe connectors produced by this process are inexpensive, less subject to material defects and, therefore, more reliable in the field.

2 Claims, 20 Drawing Figures

FIG. 6.
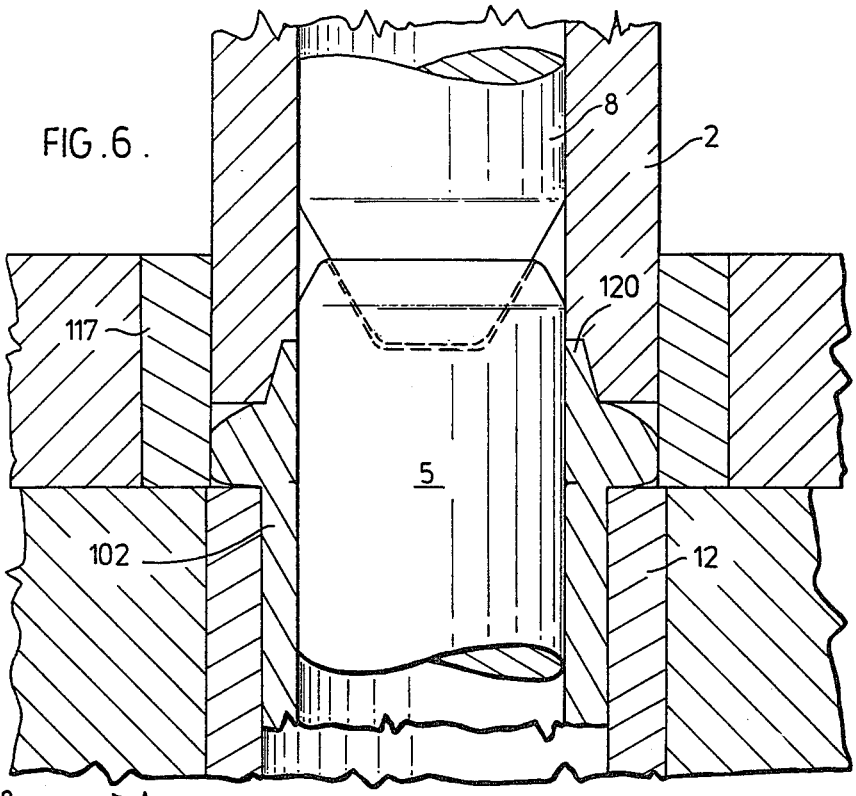
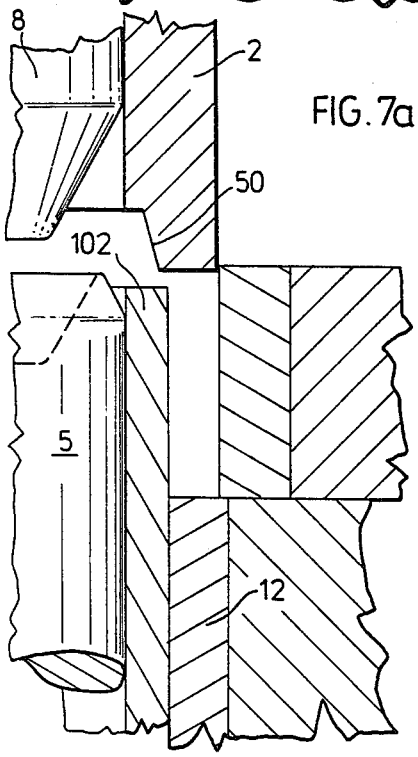
FIG. 7a.
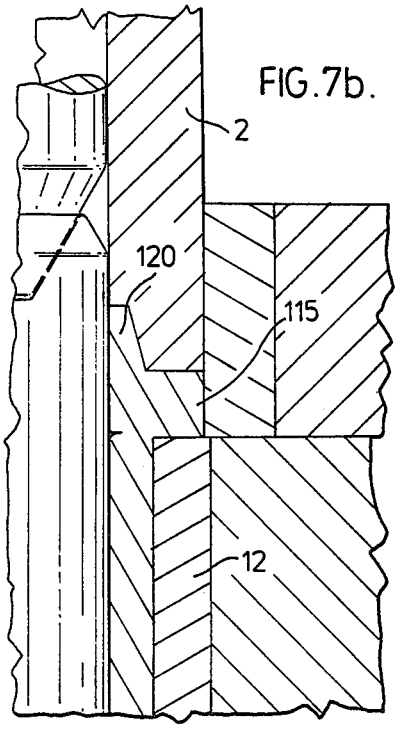
FIG. 7b.

FIG. 8.
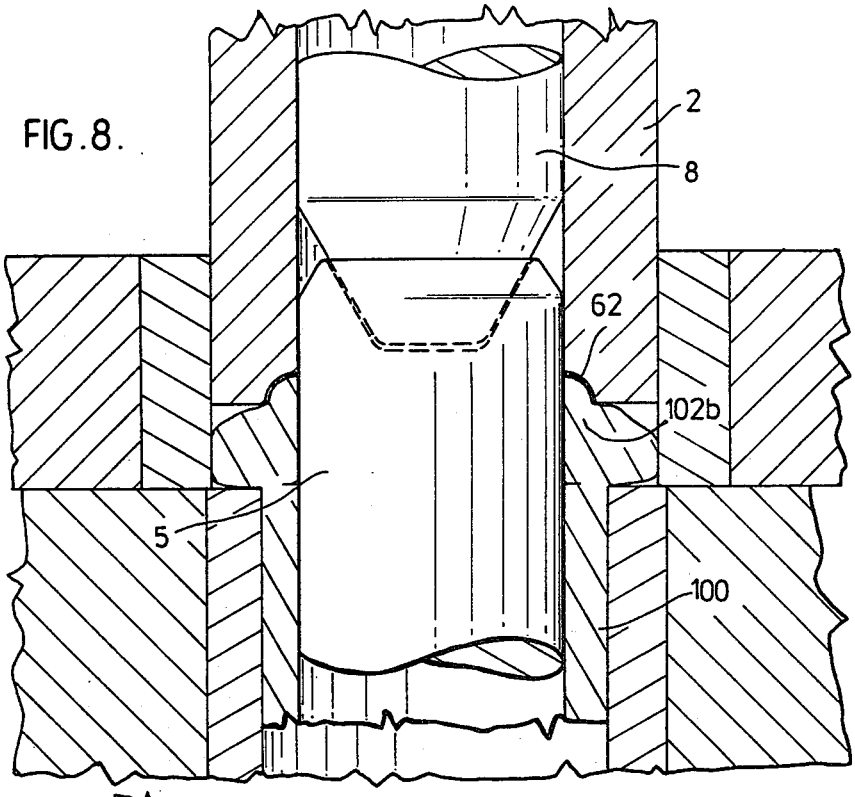
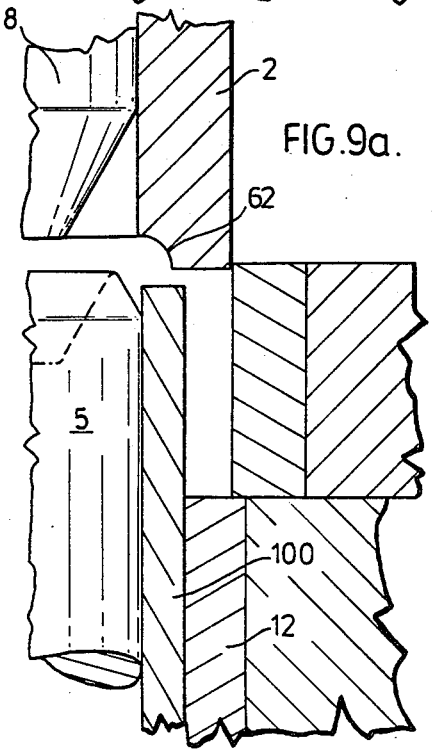
FIG. 9a.
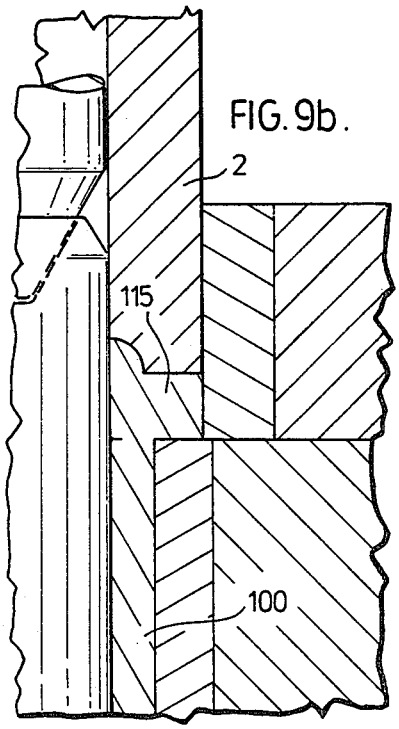
FIG. 9b.

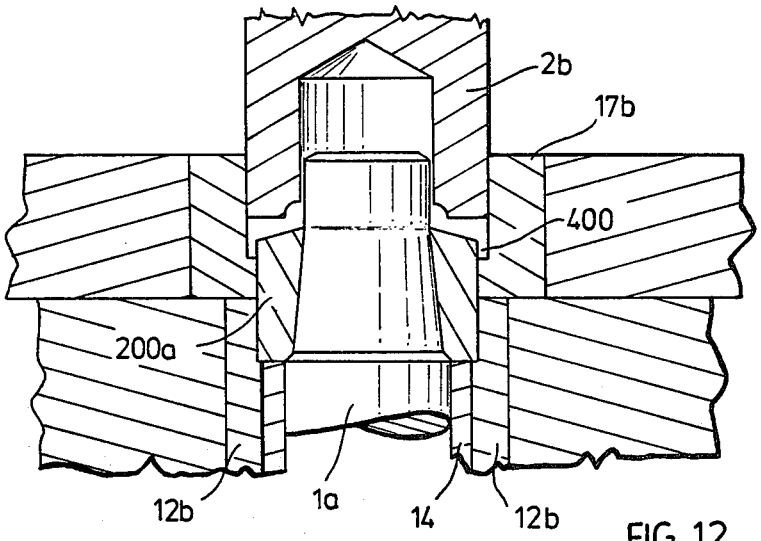
FIG. 12.
FIG. 13.
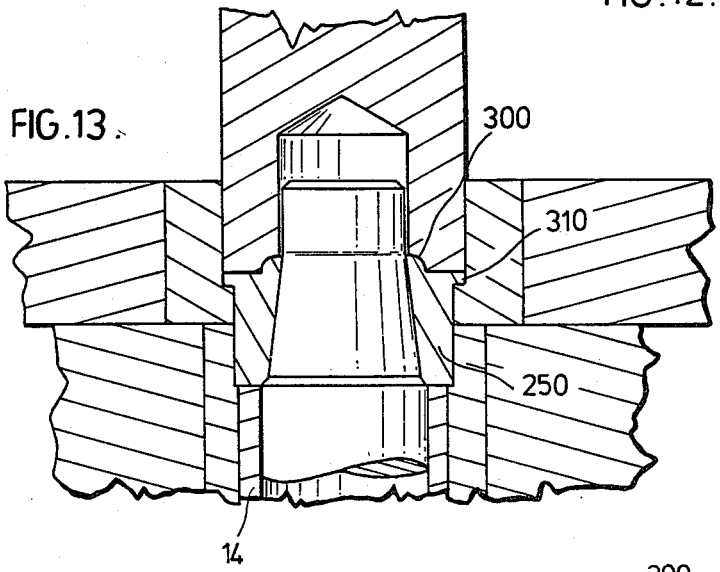
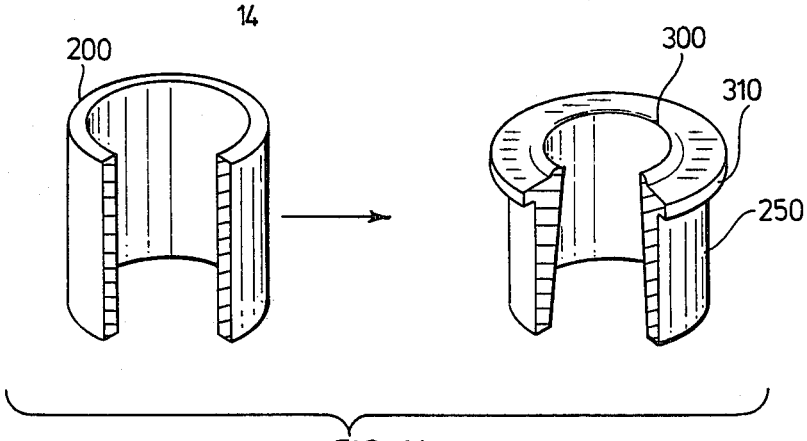
FIG. 14.

PIPE UNIONS

This application is a Continuation-In-Part of Ser. No. 614,127 filed Sept. 17, 1975, now abandoned.

FIELD OF THE INVENTION

The present invention is directed to a process for cold forming of various pipe union components by compressively loading a tubular blank and selectively supporting the blank to define a cavity into which the deformed material moves.

BACKGROUND OF THE INVENTION

Cold working of metal into a predetermined shape is commonly undertaken in extrusion and coining operations. Extrusion techniques are usually multi-stage with the solid metal blank being successively exposed to various punch and die operations until the desired end product is achieved. The punch compress the metal to exceed the compressive yield strength thereof, such that the metal will flow and assume the shape defined by the die and punch. Because the process is multi-staged, the extent of deformation in any one stage is small and controllable such that the precision of the final product is a direct result of the multi-stage operation. Obviously multi-stage operations are more expensive to operate than single-stage operations; however, the accuracy required dictates the use of multi-stage processes.

Cold working a metal by coining is commonly used; however, this operation normally requires the entire blank to be worked. The resulting product has good definition and tolerances can be controlled. However, in some circumstances it is not desirable to have the entire blank undergo the coining operation. In yet a further cold working metal process, the end of a blank is loaded compressively with a portion of the blank sidewall at one end left unsupported. With sufficient load, the compressive yield strength of the material is reached causing the metal to be upset and flow into the unsupported area. This type of process may be used in forming the head on a valve stem, the head on a nail, etc.

Mechanical pipe unions and pipe fittings for equipment are presently made by a casting operation or a welding operation. For example, a meter swivel used in the gas industry, which is essentially a small length of pipe with a flange and a spigot at one end, is produced by either casting the entire unit or by welding a flange to the body of the swivel. Swivels produced by either of these methods are somewhat prone to leaks caused by porosity in the cast swivels and cracks or flaws in the units that have welded flanges. Obviously, these units could be produced by a series of machining operations overcoming the quality control problem; however, the production costs could not be justified.

The present invention seeks to mitigate the problems experienced by the prior art structures by providing a simple production process which allows the manufacture of a number of mechanical piping connectors at reduced costs and improved quality.

SUMMARY OF THE INVENTION

The process according to the present invention, comprises cold working a metal elongated hollow open ended blank to deform a circumferential portion of the blank wall into a predetermined shape comprising the steps of supporting portions of the blank wall interior and exterior, defining a shaping section of said predetermined shape in the area of the unsupported blank wall portion, applying a compressive load on the blank ends of sufficient force to exceed the compressive yield strength of the metal blank wall thereby deforming the unsupported wall portions to cause the deforming metal to flow into the shaping section to provide said predetermined shape.

According to a preferred aspect of the invention, the process includes cold working a metal tubular blank to deform a circumferential portion of the blank wall to form an external flange on the tubular blank. The process includes the steps of supporting the interior wall of said blank along its length with a first support means, supporting the blank wall exterior portions with a second support means in a manner to provide a circumferential unsupported wall portion, such that the second support means defines an annular cavity, applying a compressive load on the blank ends of sufficient force to exceed the compressive yield strength of the metal blank thereby, deforming the unsupported blank wall portion causing the deforming metal to flow into the cavity to form the annular flange.

The process of the present invention uses a modified punch and die arrangement for providing a cavity to the exterior of the blank intermediate its end portions such that during cold working of the blank by compressive loading of the blank, the upset metal flows into the cavity and is coined by the successive movement of the punch. It is believed the coining operation limits the extent and position of any fold lines, developed during the upsetting, such that this fold line does not reduce the overall strength of the product.

Furthermore, the combined upsetting and coining operation allow for a simple process which allows adequate control on the external dimensions of the flange and the thickness thereof.

BRIEF DESCRIPTION OF THE DRAWINGS

Preferred embodiments of the invention are shown in the drawings wherein:

FIG. 6 is a partial sectional view of the apparatus with a modified punch arrangement for providing a tapered spigot;

Figure 10:
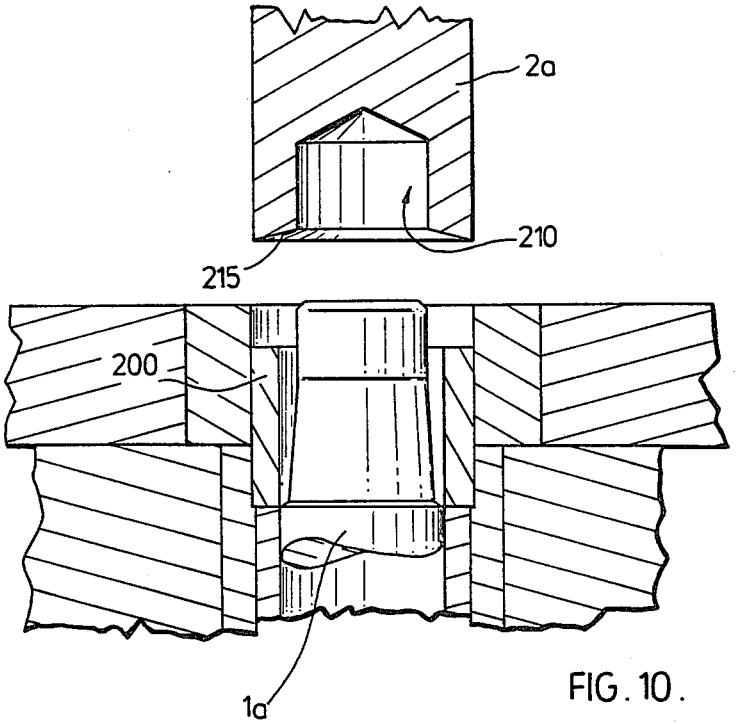
Figure 15:
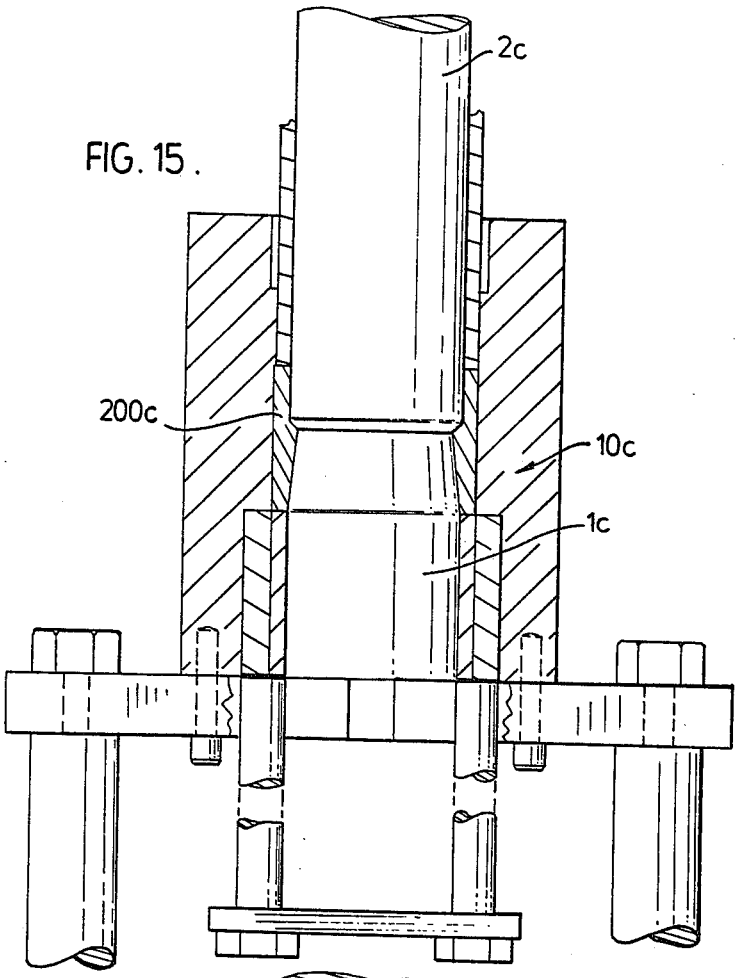
Figure 16:
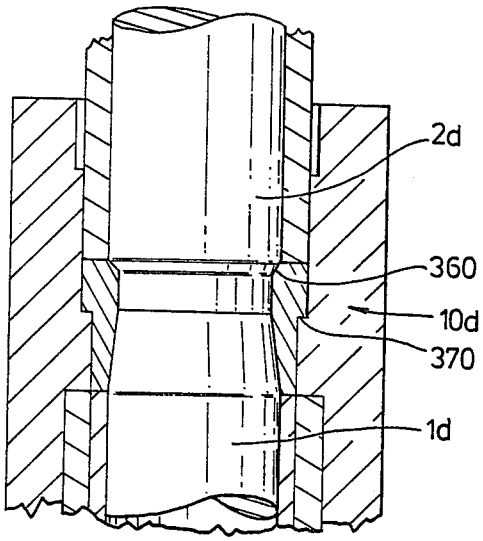
Figure 17:
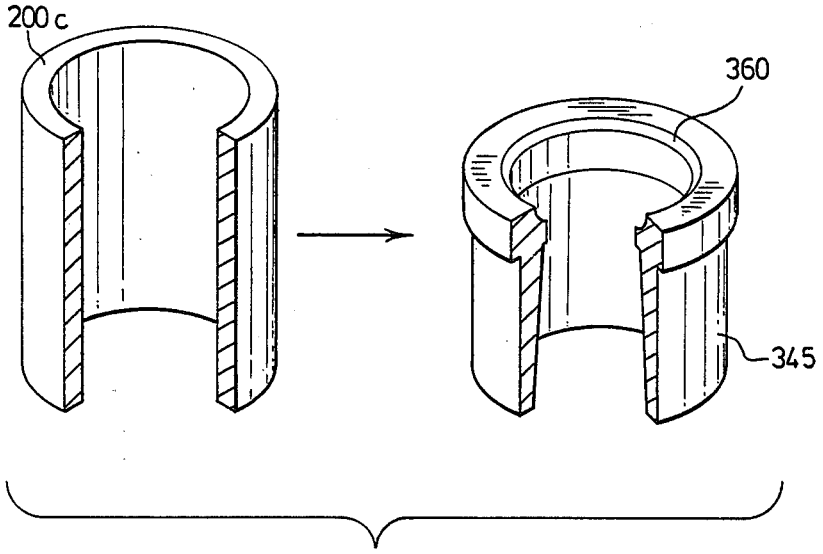
Figure 18:
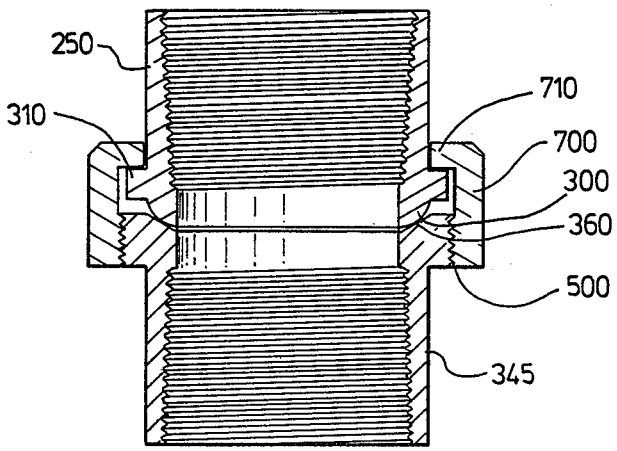

FIG. **7*a* is a partial sectional view of the apparatus of FIG. 6** prior to deformation of the blank;

FIG. **7*b* is a partial sectional view of the apparatus of FIG. 6** with the punch in its final position;

FIG. 8 is a partial sectional view of the apparatus with a modified punch for forming a bevelled spigot;

FIGS. **9*a* and 9*b* are partial sectional views of the apparatus of FIG. 8** with the blank both before and after deformation;

FIGS. 10, 11, 12 and 13 are partial sectional views of the apparatus modified for a two-stage operation for forming a male pipe connection with a tapered bore;

FIG. 14 is a partial perspective of the starting blank used in FIG. 10 and the final product produced in FIG. 13;

FIGS. 15 and 16 show the apparatus adapted for the two stage process of producing a female component compatible with the product shown in FIG. 14;

FIG. 17 shows the original blank used in FIG. 15 and the final product of FIG. 16; and FIG. 18 is a sectional view through the male and female coupling produced by the apparatus of FIGS. 10 through 16.

DETAILED DESCRIPTION OF THE PREFERRED EMBODIMENTS

Figure 1:
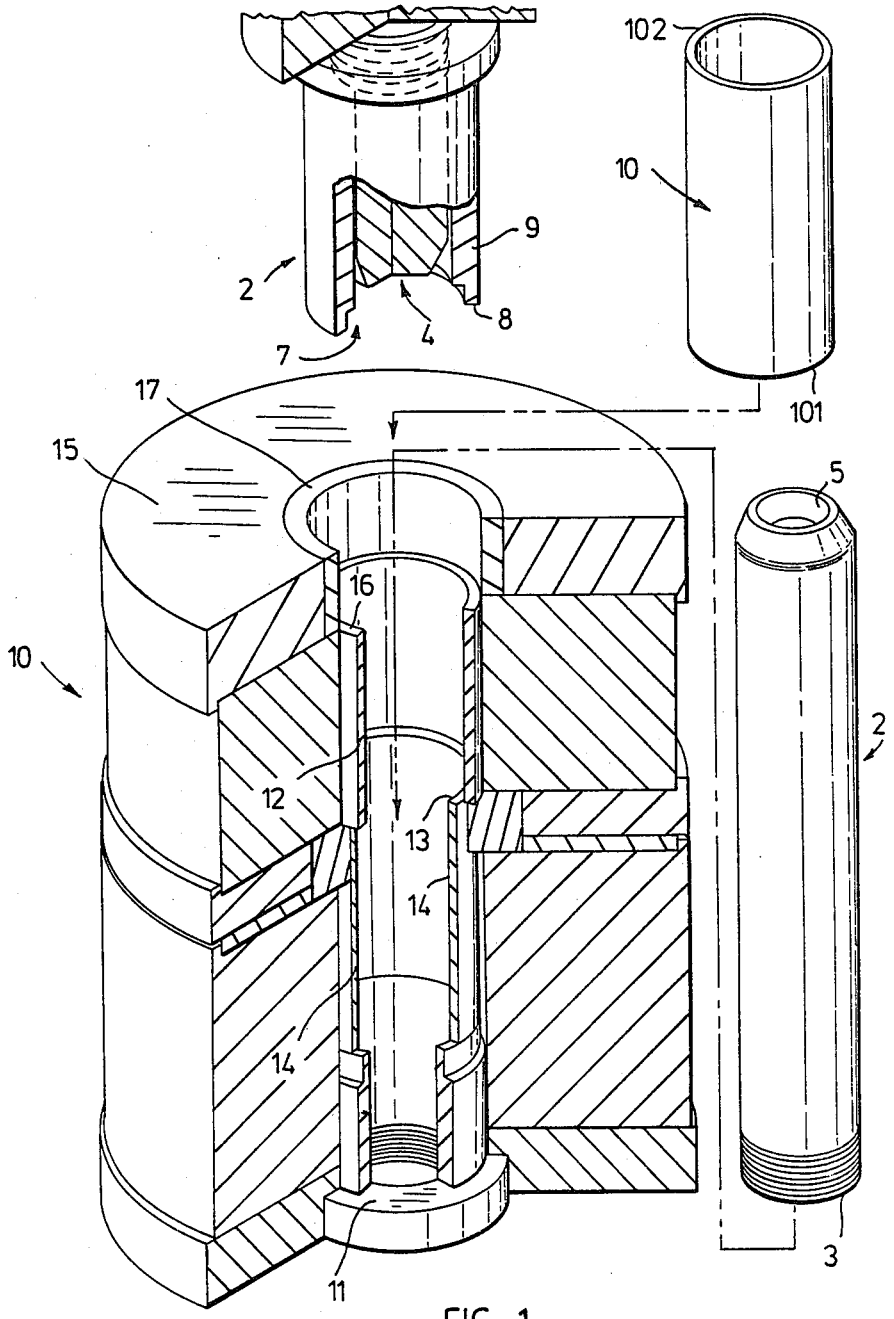
FIG. 1 is an exploded sectional perspective view of the punch and die arrangement according to the present invention.

The apparatus of FIG. 1 uses a punch 2 in combination with a die 10 and an internal plug 20 for cold working the blank 100 in a manner to provide an exterior flange intermediate its end portions. The plug 2 has a threaded lower end 3 for engaging with the internally threaded die base 11 and the plug is designed to support the interior walls of the hollow open ended blank 100 when it is being deformed.

During the forming operation, the die 10 is exposed to high internal stresses and must be designed to have sufficient strength to avoid failure thereof. To assist in this manner, an internal tooled steel sleeve 12 has been provided which is of a diameter slightly greater than the external diameter of blank 100 and thereby, provides support for the lower sidewall portions of the blank. When the blank is placed within the die, it is forced downwardly such that the sleeve 12 surrounds at least a portion of the blank and the base 101 of the blank, abuts with the upper surface 13 of the ejector sleeve 14. Movement of the ejector sleeve may be controlled by a hydraulic cylinder, a crank arrangement or other means for moving the sleeve upwardly to eject the deformed blank. The diameter of the plug 2 approximately corresponds to the internal diameter of the ejector sleeve 14 such that the lower portion of the blank is tightly enclosed by the tooled steel sleeve 12, the internal plug 2 and the ejector sleeve 14.

Once the blank has been positioned within the die, the punch 2 is moved downwardly to contact the upper portion 102 of the blank which is extending slightly above the upper portion of the sleeve 12. The punch 2 has been provided with a spring loaded section 4 which co-operates with the upper portion 5 of the plug such that during downward movement of the punch, the spring loaded section 4 and the upper portion 5 of the plug engage and thereby align the punch and die.

The lower surface 7 of the punch has been provided with a stepped cross section such that at least a portion of the upper end of the blank is located within this stepped region. The upper portion 15 of the die has an interior tool steel insert 17 which has an internal diameter corresponding to the desired diameter of the flange to be formed. The outer diameter 9 of the punch is sized to approximately correspond to the internal diameter of this sleeve 17 such that the lower edge 8 of the punch, the upper portion 16 of the sleeve 12 in combination with the internal diameter of sleeve 17, define a cavity into which the blank may deform. In its initial position, the blank 100 extends above the sleeve 12 and a portion of the exterior wall of the blank is left unsupported between the upper portion of sleeve 12 and the lower portion of the punch. The interior stepped portion of the punch provides support for the end 102 of the blank. Similarly, the internal portion of the blank is supported by plug 2.

Figure 2:
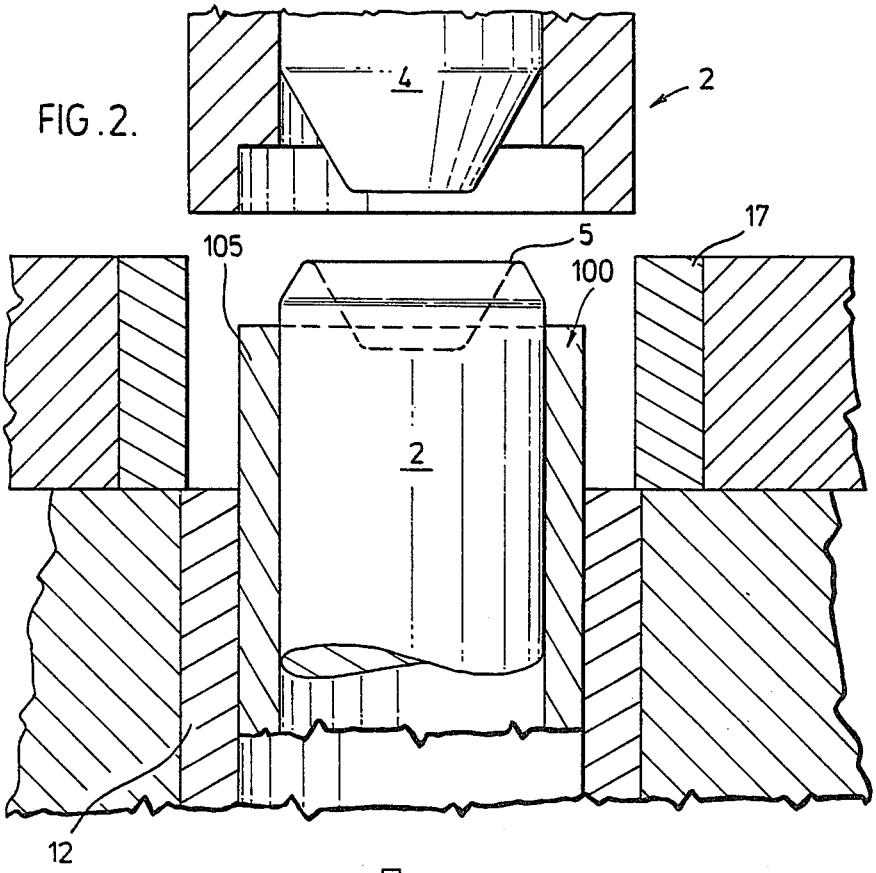
FIG. 2 is a partial section through the apparatus of FIG. 1, showing the inter-relationship between the punch and die cavity.

As can be seen in FIG. 2, the blank 100 has been positioned within the die and an upper portion 105 of the blank extends above the tool steel sleeve 12. The plug 2 is supporting the interior walls of the blank and the lower portion of the blank is supported by the sleeve 12. As the punch 2 is moved downward, towards the die the center portion 4 interacts with the upper portion 5 of the plug to assure alignment of the exterior of the punch and sleeve 17. Subsequent downward movement of the punch is not limited as the center portion is spring loaded and slides upwardly.

Figure 3:
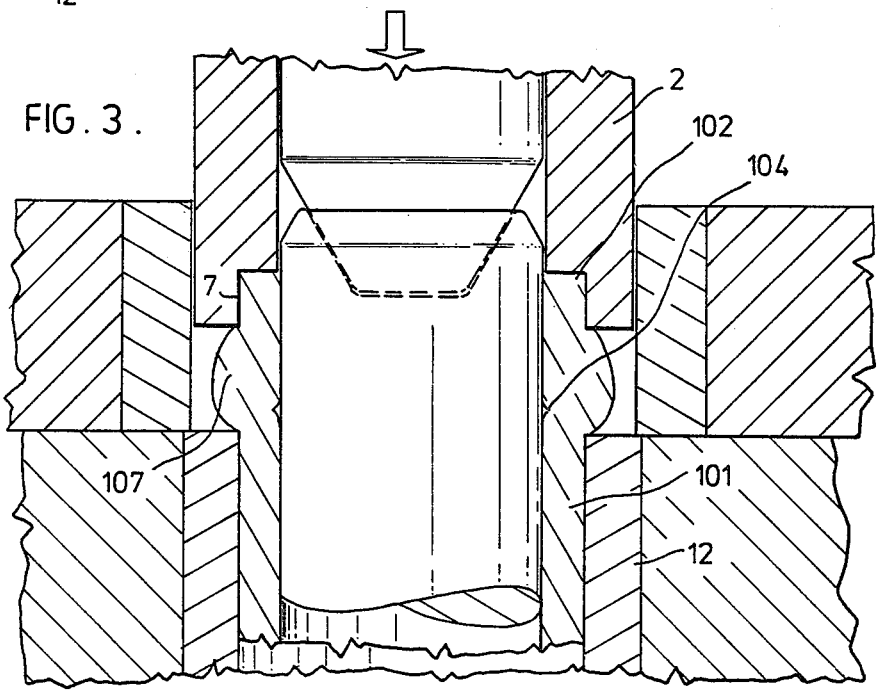
FIG. 3 is a partial sectional view similar to FIG. 2, showing a blank undergoing deformation.

As shown in FIG. 3, the center portion of the punch has fully engaged within the upper portion 15 of the plug and the blank 100 is undergoing deformation. The upper portion 102 of the blank is supported within the stepped portion 7 of the punch while the lower portion of the blank 101 is within the sleeve 12. The unsupported exterior wall portion 107 is deforming outwardly as the force applied by the punch 2 has exceeded the compressive yield strength of the blank upsetting the metal blank. A slight fold line 109 has occured on a portion of the interior wall of the blank caused by the outward bulging of the blank during the initial stages of the deformation process. This may not occur if a blank of greater wall thickness is used.

In the present invention, it is preferred to use a blank of reduced wall thickness in order to reduce overall material costs and also reduce the magnitude of the forces exerted on the die. However, there is a relationship between the total amount of deformation, the distance through which it is to be moved and the thickness of the blank wall in order to avoid material defects formed during the single-stage cold working operation. In cases where the extent of deformation is great, multi-stage operations are used and/or the thickness of the blank wall is increased. One particular problem is a direct result of the unsupported wall portion of the blank bowing outwardly during the initial stages with this bowing being reflected in the end product by a fold line visible on the interior of the finished product. This bowing action, and particularly the location and extent of the fold line, is limited due to the cavity defining sleeve 17. If the sleeve is of too great a diameter or the blank wall thickness is too thin, a complete collapse or folding of the blank wall may occur. This is not desirable, as the quality of the resulting product is affected. The parameters for thin wall single-stage deformation should be selected such that, although some bowing may occur during the initial stages, complete deformation is a result of the upsetting of the metal in combination with the bowing. When this occurs, the sleeve 17 causes upset metal to to flow inwardly toward the plug and this limits the extent of the fold line as well as shifts its position somewhat downwardly. This is apparent from FIG. 5, where the fold line 10 is not positioned on the center line of flange 115 and is of reduced length compared to the circumstance had complete folding of the blank sidewall occurred.

Therefore, from the above, it can be appreciated that the position and extent of the fold line produced when deforming thin walled blanks in a single-stage cold working operation may be controlled within certain ranges of deformation by positively limiting the extent of bowing by the size of the die cavity, such that after the metal is upset, it will be forced to flow inwardly and slightly downwardly. This movement of metal is further enhanced by the coining action of the punch and die.

Control of the bowing action of the blank may be particularly valuable when the blank material is a piece of electrically seam welded pipe as the weld portion tends to be somewhat harder and prone to cracking if the deformation is too great. This type of blank is used to reduce material costs as it is readily available and in common use.

Figure 4:
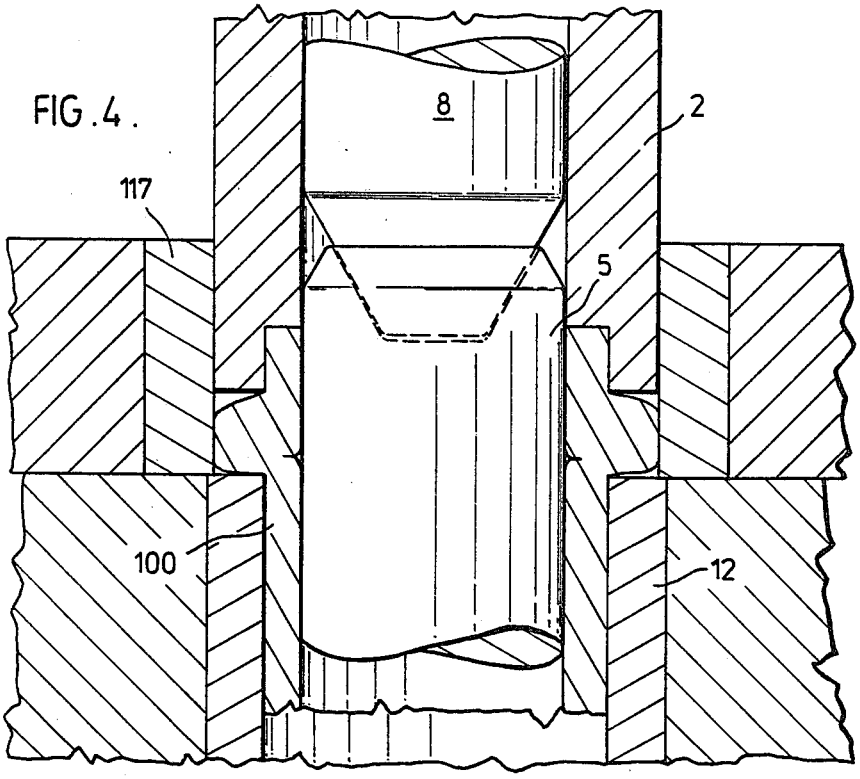
FIG. 4 is a partial sectional view through the press with the punch coining the flange on the blank.

In FIG. 4, the deformation process has continued and the downward movement of the punch has caused a coining deformation of the bulged portion of the blank. This coining action produces a well defined flange 15. From a review of FIGS. 4 and 5, it can be seen that sleeve 17 acts to positively limit the bulging action of the tubular blank and allows the coining action of the lower portion of the punch and the upper portion of the sleeve 12 to accurately form the flange 115.

Figure 5:
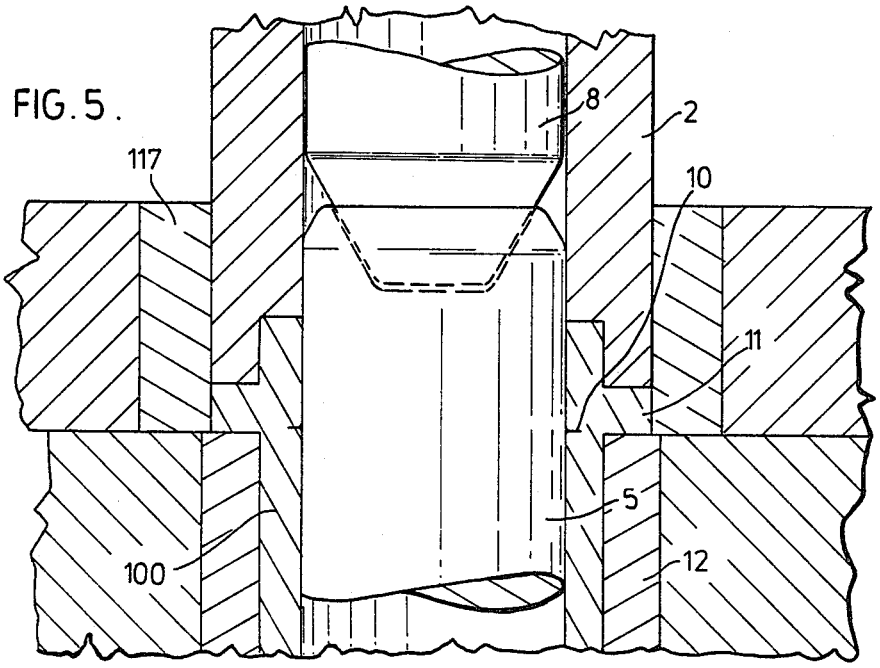
FIG. 5 is a partial sectional view of the apparatus showing the blank in its final deformed state.

As shown in the formed product of FIG. 5, the fold line 109 has been limited by the coining operation and is normally of an extent less than the original thickness of the blank. This fold line normally occurs slightly above the lower extreme of the flange 115 such that the flange compensates for this slight defect.

Therefore, in reviewing FIGS. 2 through 5, it can be appreciated that the downward movement of the punch causes a high compressive load on the blank 100 such that the compressive yield strength of the blank is reached. At this point, thickening of the unsupported sidewalls of the blank occurs which continues with the downward movement of the punch. After sufficient downward movement the upsetting operation is compounded by the coining action of the lower portion of the punch and the upper portion of sleeve 12. Thus, the external diameter of the flange is well defined by sleeve 17 and the flange thickness is determined by the original unsupported length of the blank and the thickness of the blank. Sleeve 17 may positively limit the extent of blank bowing during initial stages of the operation and redirects the upset material inward with further downward movement of the punch.

As can be seen in the final product of FIG. 5, the upper portion of the blank 102, which may constitute a spigot, has been supported and maintained throughout the deformation process. Thus, it can be appreciated that the punch and die according to these Figures, allows for the forming of a flange intermediate the end portions of a tubular blank and preferably with the single stroke of the punch. Also the thickness of the flange is determined by the length of the blank.

The embodiments shown in FIGS. 6 and 7, and FIGS. 8 and 9, are to a punch arrangement which allows the formation of a modified spigot portion at the upper end portion 102 of the blank. In FIGS. 6 and 7, a tapered spigot portion 120 is provided which may be used in cases where the spigot must be reduced in diameter than the diameter of the blank. In forming the tapered spigot of reduced wall thickness, the upper portion of the blank is also upset during the downward movement of the punch and cold worked into the desired shape. The forming of the flange is similar to that described with respect to FIGS. 2 through 5, however, the upset material at the end of the blank also flows downward and further limits the extent of the fold line.

In FIG. *7a* it can be seen that the punch 2 for forming this tapered spigot has a tapered lower section 50 and at the upper portion of the blank 102, is deformed with the downward movement of the punch. With further downward movement of the punch as shown in FIG. *7b*, the tapered spigot portion 120 has been provided with the flange 115 provided intermediate the end portions of the blank. Thus in using this specially configured punch, a spigot portion may be formed of a wall thickness less than the thickness of the blank wall.

With respect to FIGS. 8 and 9, the punch 2 has been provided with a curvilinear recessed portion 62 for producing a spigot of similar section. This type of spigot is particularly useful in forming the male components for pipe unions. FIG. *9a* shows the punch prior to contact with the blank 100 while FIG. *9b* shows the punch in its final downward position. FIG. 8 shows the simultaneous deformation of the upper portion 102*b* of the blank and the upsetting and coining of the bulging portion of the blank in producing the flange 115.

In some circumstances, such as for meter swivels, it is desired to retain the end portion of a tubular blank and position the flange intermediate the end portions to result in a product having the desired flange thickness and diameter. However, in other circumstances, it is desired to adapt the spigot portion to a special shape such as that of FIG. 7, where the spigot and flange may subsequently be coated to provide an insulating flange or that of FIGS. 8 and 9, where a male component of a pipe union is simultaneously formed with the upsetting and coining of the blank to produce a flange intermediate the end portions.

Figure 11:
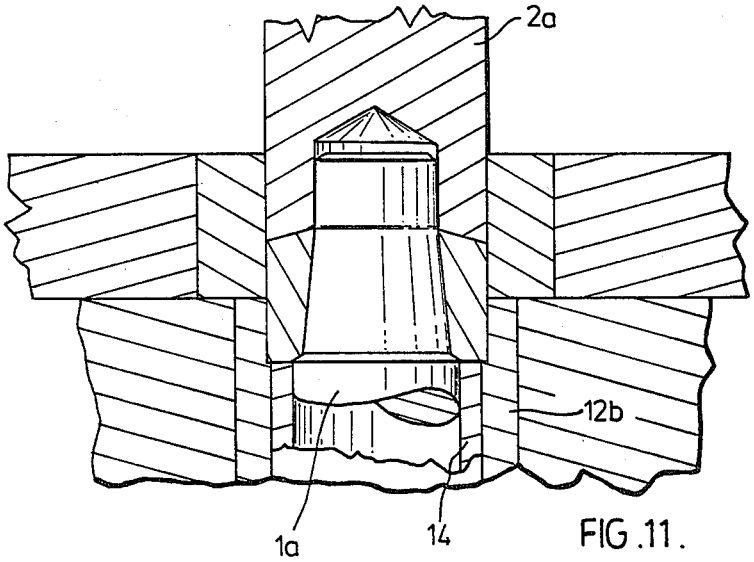

FIGS. 10 through 13 illustrate a multi-stage process for transforming the tubular blank 200 shown in FIGS. 10 and 14 into the male component of a pipe union shown as 250 in FIGS. 13 and 14. The plug 1*a* has been provided with a truncated conical upper section for allowing thickening of the interior wall of the blank. With the downward movement of the modified punch 2*a*, which has been provided with a recessed portion 210, having sidewalls corresponding to the conical portion of the punch, the upper portion of the blank is contacted by the lower sloped edge 215 of the punch such that a force is exerted on the blank causing the material to upset. Further movement of the punch causes a flow of the material generally downwardly and inwardly until the blank contacts the upper conical section of the plug. FIG. 11 illustrates the modified form of the blank after sufficient downward movement of the punch 2*a*. After the blank has taken on the shape shown in FIG. 11, the punch 2*a* is withdrawn and the modified blank is removed from the die by the upward movement of the ejector sleeve 14.

The modified blank, produced by the apparatus of FIG. 11, is subsequently placed in the tooled steel die 12*b* of FIG. 12. The punch 2*b* cooperates with the die 12*b* to upset the deformed blank 200*a* and cause the formation of a curvilinear seal portion 300 as well as the exterior flange 310. With respect to FIGS. 12 and 13, the downward movement of the modified punch 2*b* forms a flange portion 310 intermediate the end portions of the modified blank 200*a* by first upsetting the metal and forcing it out into the cavity defined by the lower edge of the punch and the modified tool steel insert 17*b*. Continued downward movement of the punch which first caused upsetting of the blank, now causes coining of the material which is moved outwardly into the cavity 400 to provide good definition of the flange 310. The spigot portion of the blank 200*a* has also undergone modification, allowing the formation of the curvilinear sealing portion 300. As with the other structures, the finished product may be removed from the apparatus of FIG. 13 by moving the ejector sleeve 14 upwardly, after the punch has been removed.

A complimentary female component for the male component shown in FIG. 14 may be produced by the multi-stage process illustrated with respect to FIGS. 15 and 16. In FIG. 15, a blank 200*c* has been upset by the downward movement of the punch 2*c* and forced to take on the shape defined by the cavity, bound by the modified punch 2*c*, the modified plug 1*c* and the modified die 10*c*. This deformed blank 2*c* is then inserted in a second punch and die apparatus as shown in FIG. 16 with the punch 2*d*, the die 10*d* and the plug 1*d*, defining the cavity into which the material of the blank flows. This results in a complimentary female pipe component of a pipe union for the male component 250 with the female component having a sloped portion 360 for receiving the male component to provide a line seal. The thickened sidewall 370 of the female connector may be externally threaded to facilitate mechanically coupling of the male and female components as shown in FIG. 8. Furthermore, the inside surface of the female component is tapered which can subsequently be internally threaded for connection with a pipe.

FIG. 17 shows the shape of the original blank 200*c* used with the punch and die of FIG. 15 and the transformed final product produced by the die and punch arrangement of FIG. 17.

The forged products, produced by these multi-stage processes, are complimentary and may be joined in the manner shown in FIG. 18. The female component 345 has been provided with threads 500 on the exterior portion for engagement with a nut member 700 having an inwardly directed ledge 710. This nut member is adapted to slide over the exterior portion of the male component 250 with the inwardly directed ledge 710 engaging the flange 310. The specially adapted curvilinear spigot 300 is received within the sloped portion 360 of the female connector such that a seal is provided between these components with the tightening of the nut member 700. It can be appreciated that the interior walls of the male and female components may be threaded for engagement with a threaded pipe.

Although various preferred embodiments have been described herein in the invention, it will be understood that variations may be made thereto, without departing from the spirit of the invention or the scope of the appended claims.

The embodiments of the invention in which an exclusive property or privilege is claimed are defined as follows:

1. A multi-stage process for cold working a metal tubular blank to deform said blank in multiple stages to form a male component of a pipe union, said process comprising placing a tubular blank in a die cavity which supports the exterior surface of said blank, a tapered plug being positioned within said blank where the base of the blank contacts the tapered plug, supporting the base of the blank, forcing a punch against the blank upper end, said punch having an annular angled face which deforms the blank wall towards and against said tapered plug to form a shortened blank of thicker wall, removing said punch and in a second stage forcing a punch having a recessed face portion of a configuration which forms a flange and spigot for co-operating with a female component of a pipe union.

2. A multi-stage process for cold working a metal tubular blank to deform said blank in multiple stages to form a female component of a pipe union, said process comprising placing a tubular blank in a die which supports the exterior of said blank, locating separable plug portions within said blank to support upper and lower portions of said blank and to define a cavity in the area of the unsupported interior wall, supporting a first end of said blank and forcing a punch against the second end of said blank to deform the unsupported wall portion inwardly into the cavity and against said separable plug portions and said punch and positioning another set of separable plug portions within the worked blank to define a cavity interior of the blank which defines spigot receiving area and flange for a co-operating male component of a pipe union, forcing a punch along said plug to deform the blank wall into said cavity to form the finish surface from said female components.

* * * * *